US007186909B2

(12) United States Patent
Bee, Jr. et al.

(10) Patent No.: US 7,186,909 B2
(45) Date of Patent: Mar. 6, 2007

(54) ERGONOMIC KEY POUNDER

(76) Inventors: Donald Franklin Bee, Jr., 1616 Cypress Ct., Hoffman Estates, IL (US) 60194; Patricia Lynne Masek, 1616 Cypress Ct., Hoffman Estates, IL (US) 60194

( * ) Notice: Subject to any disclaimer, the term of this patent is extended or adjusted under 35 U.S.C. 154(b) by 481 days.

(21) Appl. No.: 10/800,787

(22) Filed: Mar. 15, 2004

(65) Prior Publication Data

US 2005/0211067 A1 Sep. 29, 2005

(51) Int. Cl.
*G10G 7/00* (2006.01)

(52) U.S. Cl. ..... 84/459

(58) Field of Classification Search ..... 84/453, 84/455, 458, 459

See application file for complete search history.

(56) References Cited

U.S. PATENT DOCUMENTS

2002/0036206 A1* 3/2002 Bergman et al. ..... 220/754

2005/0187498 A1* 8/2005 Miller ..... 601/72

OTHER PUBLICATIONS

Clair Davies, The Davies Key Striker, Piano Technicians Journal, May 1997, p. 16, vol. 40 No. 5, David Hanzlick, Kansas City, MO, USA.

Robert Hohf, Ergonomic Key Bonker, Piano Technicians Journal, Feb. 2001, p. 8, vol. 44 No. 2, Dan W. Hall, Kansas City, MO, USA.

* cited by examiner

*Primary Examiner*—Kimberly Lockett
(74) *Attorney, Agent, or Firm*—Babcock IP, PLLC

(57) ABSTRACT

A key pounder tool useful during the tuning of pianos and the like. The key pounder has a shaft about which a grip adapted for holding by the human hand is positioned. The shaft extends from the grip to a bumper end where a resilient non-slip bumper is coupled. The bumper having a diameter greater than or equal to the shaft. A removable combination strap that may be coupled to a strap end of the shaft is adaptable to hand and wrist configurations via a removable connection strap which couples the strap to the grip in the hand configuration. The strap may be adjustable via an adjustment means such as a sliding buckle, hook to loop fastener or the like.

18 Claims, 8 Drawing Sheets

ERGONOMIC KEY POUNDER

BACKGROUND OF THE INVENTION

1. Field of the Invention

The invention relates to a key striker tool useful in the process of tuning pianos and the like. More specifically, the invention relates to an ergonomic key striker that increases tuning efficiency and ergonomically reduces user strain.

2. Description of Related Art

A piano tuner typically initiates the tuning process by striking the instrument's keys with his/her fingers to produce audible tones. The tuner evaluates these tones and performs adjustments to modify the tones to desired pitches.

Tones produced by pianos are the result of strings vibrating within the instrument. These vibrations are caused by key strikes that transmit a force through a mechanical linkage. The pitch of each tone is dependent on the tension in the string that produces the tone. Accordingly, the instrument adjustments the tuner performs entails physically altering the tension within each string until the desired pitch is reached. After each adjustment, the tuner again strikes the corresponding key to ensure that the correct pitch has been attained and remains stable.

Most pianos contain two hundred plus strings, one to three per piano key. During the process of tuning a piano, the key striking action may be repeated one thousand or more times. Key strikes are referred to as "test blows". There are two types of test blows, the first being a soft key strike used to evaluate the string's pitch. The second type is a hard, pounding strike used to stabilize string tension. In order for a test blow to properly stabilize the string tension and pitch, it must be delivered with sufficient force to temporarily unseat the string at a number of contact points along its length. Repeated test blows, especially hard test blows, may cause pain in the fingers, hands, and wrists of the individual performing the tuning. Repeated test blows also add to the time required to tune the instrument. In either case, the end result is reduced tuning efficiency, thereby reducing the tuner's ability to perform his or her trade with maximum profit.

The key strikes may be performed with the aid of a key striker tool. Prior key strikers have incorporated a wooden dowel or turned wooden handle adapted for gripping, a non-adjustable leather strap that is attached to both ends and a large, for example 19 mm diameter, felt circle glued to one end as the strike point.

While the prior key strikers are operable, there are several disadvantages. The width of a typical natural (white) piano key is slightly less than 22 mm. This leaves a 19 mm strike point with only 3 mm of clearance, total, to avoid striking adjacent keys. In the event that two keys are inadvertently depressed during a pitch evaluation strike, the strike must be repeated. Repeated key strikes significantly increase the amount of time required to tune an instrument and can add to the likelihood of hand and wrist pain or injury from the stress induced by this type of repetitive motion.

Another disadvantage of the prior key striker is the close proximity of the handle to the strike point. In this configuration, both the user's hand and the handle obstruct the user's line of sight to the strike point. This increases the possibility that the user will depress additional keys with each test blow. The close handle to strike point proximity also increases the chance that the user's hand will inadvertently strike adjacent sharp (i.e. black) keys, also necessitating a re-strike.

Still another disadvantage of the prior tools is the common use of felt for the strike point. Since there is a low coefficient of friction between piano keys and the felt, there is a tendency for felt tipped strike surfaces to slip off of the targeted black keys and consequently strike adjacent white keys, also requiring a re-strike.

The use of a hard, smooth wooden handle further imparts a twofold disadvantage. First, the smooth handle forces the requirement of a strap for the user to gain "leverage" on the tool. And second, the hard gripping surface transmits the force of the test blows directly to the user's hand with minimal shock absorption, increasing the chance of finger, hand or wrist strain.

Yet another drawback of this device is the design of its strap. The strap is not adjustable and cannot suit different hand sizes. And since the strap is permanently attached, it also limits the way a user may choose to hold and use the device.

Another form of prior key striker uses a T-shaped design. The device is comprised of a palm-sized block of wood with a hole drilled in the center of one face of the block. Into the drilled hole, the tail end of a felt tipped piano hammer is glued, such that the hammerhead extends out from the block of wood. The face of the piano hammer functions as the device's strike point. A fixed leather strap is permanently attached to the block of wood, on two laterally opposing sides, such that it wraps over the side opposite the hammer projection. To employ the device, the user places a hand under the leather strap with the palm face down to grasp the block of wood. The user then swings the device downward until the hammer face makes contact with a targeted piano key.

A major drawback of the T-shaped design is the location of its strike point, the piano hammer face, as it is centered under the block of wood, as well as the user's hand. Both the block of wood and the user's hand obstruct the user's line of sight to the strike point. This promotes the possibility that the user will unintentionally depress multiple keys with each test blow, again leading to re-strikes.

Another significant drawback of the T-shaped design is the distance from the user's palm to the device's strike point. Because this distance is in excess of two inches, the user is prevented from playing wide intervals (two simultaneous notes, such as a musical $6^{th}$, $10^{th}$ or $17^{th}$ chord) with the hand that operates the key striker. In order to tune an instrument aurally, it is imperative that the hand used to operate the key striker be available to play wide intervals, which is impossible while wearing the device. Therefore, an aural tuner using this device requires numerous additional hand movements leading to significantly longer instrument tuning times.

The prior T-shaped key strikers also suffer from the felt tipped low coefficient of friction strike point and non-adjustable strap deficiencies identified herein above.

Therefore, it is an object of the invention to provide an apparatus that overcomes deficiencies in the prior art.

BRIEF DESCRIPTION OF THE SEVERAL VIEWS OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

Table of Parts

| | |
|---|---|
| 15 - Key Pounder | 16 - Combination Strap |
| 17 - Grip | 18 - Shaft |
| 18a - Shaft Taper | 18b - Stepped Profile |
| 18c - S-shaped Profile | 19 - Bumper |
| 19a - Bumper Post | 20 - Sliding Buckle |
| 21 - Connecting Strap | 22 - Slide Strap |
| 23 - Drilled Hole | 24 - Attachment Bolt |
| 25 - Bumper End | 26 - Shaft Hole |
| 27 - Threaded Hole | 28 - Stationary Strap |
| 29 - Strap Hole | 30 - Grommet |
| 31 - First Buckle Opening | 32 - Second Buckle Opening |
| 33 - Slide Strap Loop Fastener | 34 - Connecting Strap Fastener |
| 34a - Connecting Hook Fastener | 34b - Connecting Loop Fastener |
| 35 - Square Bumper | 36 - Strap End |

DETAILED DESCRIPTION OF THE INVENTION

Figure 1:
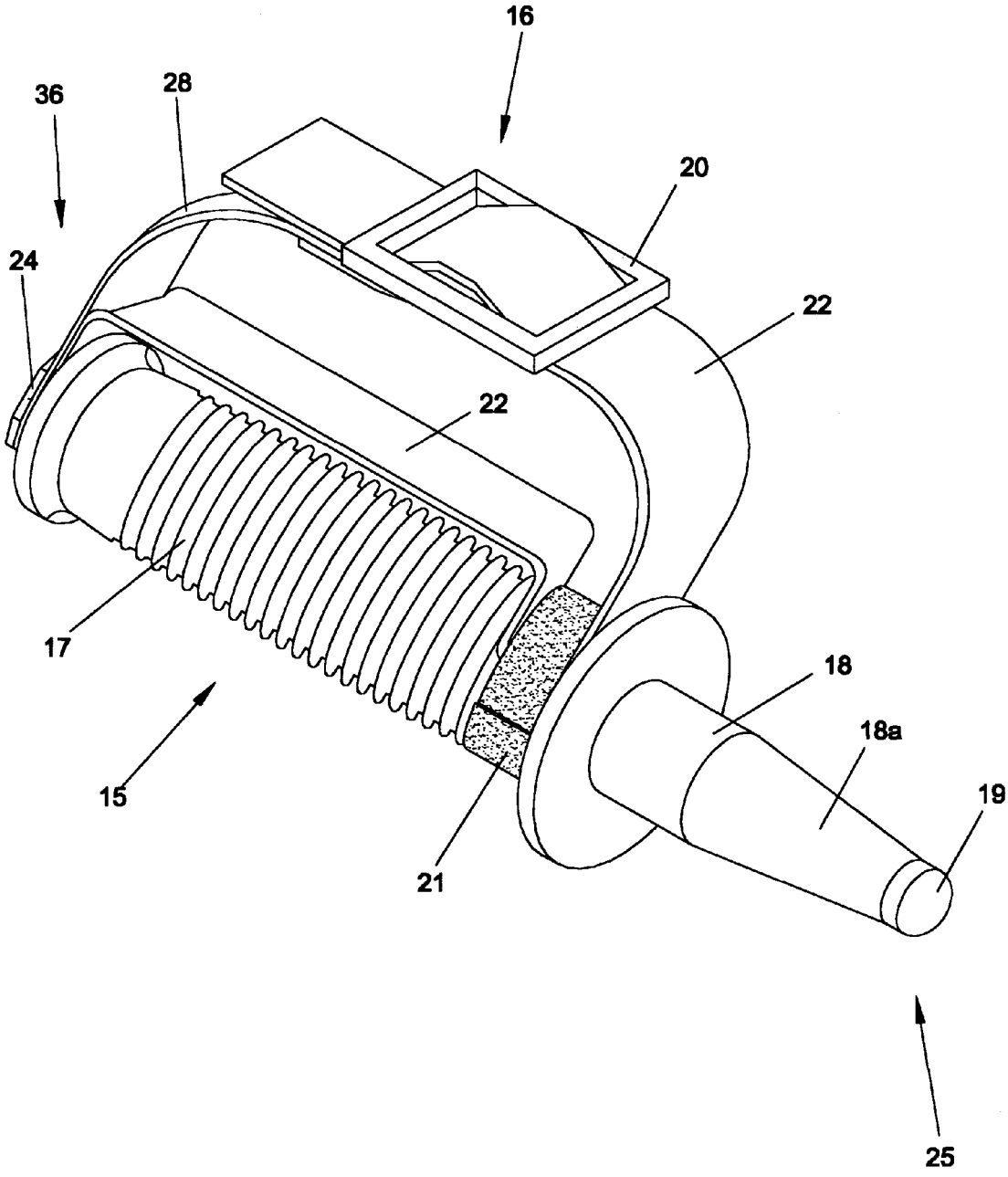
FIG. 1 is a perspective view of a first embodiment of the invention with a combination strap configured as a hand strap.

A first embodiment of the key pounder 15 with combination strap 16 configured as a hand strap is exhibited in FIG. 1. An impact-absorbing grip 17 is fitted around the upper portion of an elongated shaft 18. The shaft 18 has a taper extending from the grip 17 to a bumper end 25 to which a resilient bumper 19 is removably coupled. Alternatively, as discussed herein below, a shaft 18 with a smaller diameter may be used, avoiding the need to taper the shaft 18 as shown. The bumper 19 acts as the strike point of the key pounder 15. Also attached to the shaft 18 and grip 17, is a combination strap 16, for example, comprised of a series of three straps, outfitted with hook and loop fasteners or the like, and a sliding buckle 20 (see FIG. 4).

Figure 2:
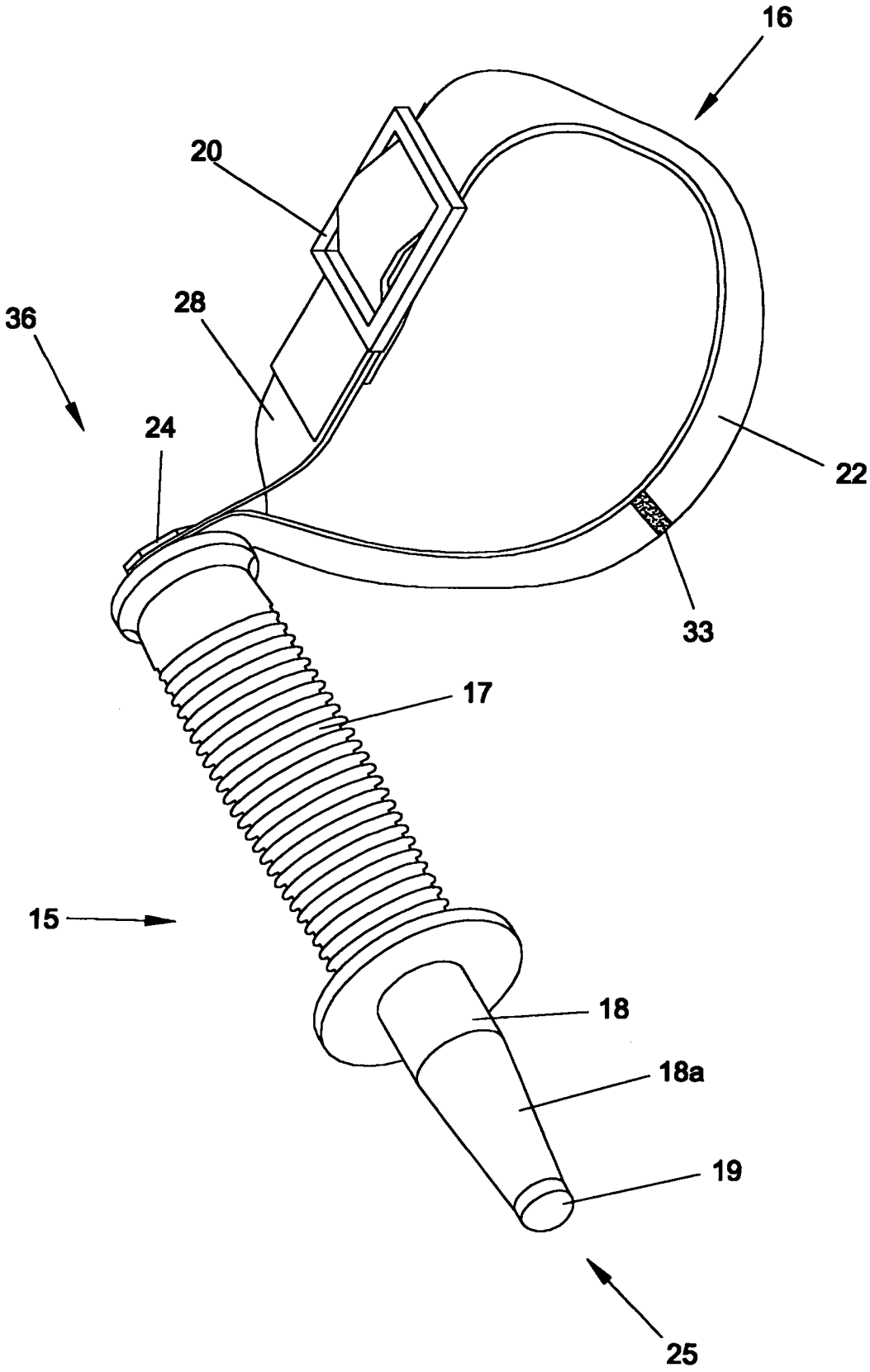
FIG. 2 is a perspective view of the first embodiment of the invention with the combination strap configured as a wrist strap.

The combination strap 16 may be alternatively configured to form a snug fitting hand strap, as shown in FIG. 1, or a looser fitting wrist-strap, as shown in FIG. 2, by removing the connecting strap 21. The resulting hand or wrist-strap can also be adjusted to comfortably fit the size of the user's hand by altering the sliding buckle 20 position on the slide strap 22, which is threaded through the sliding buckle 20. The combination strap 16 may also be removed completely, as presented in FIG. 3, at the user's discretion.

The impact-absorbing grip 17 may be constructed of a non-slip, pliant material such as rubber, vinyl or a polymer of similar properties and may, if desired, be obtained pre-manufactured from any one of many grip manufacturers. The grip 17 may be formed with impact-absorbing features such as a multitude of axially radiating flexible ribs or foam rubber padding. The grip 17 may have a nominal outside grip surface diameter of 19 mm to 22 mm and an approximate length of 100 mm, typical of grip applications adapted for the average adult human male hand. Similarly, the grip 17 dimensions may be adjusted for ease of use by the expected dimensions of the hands of other desired users.

Figure 4:
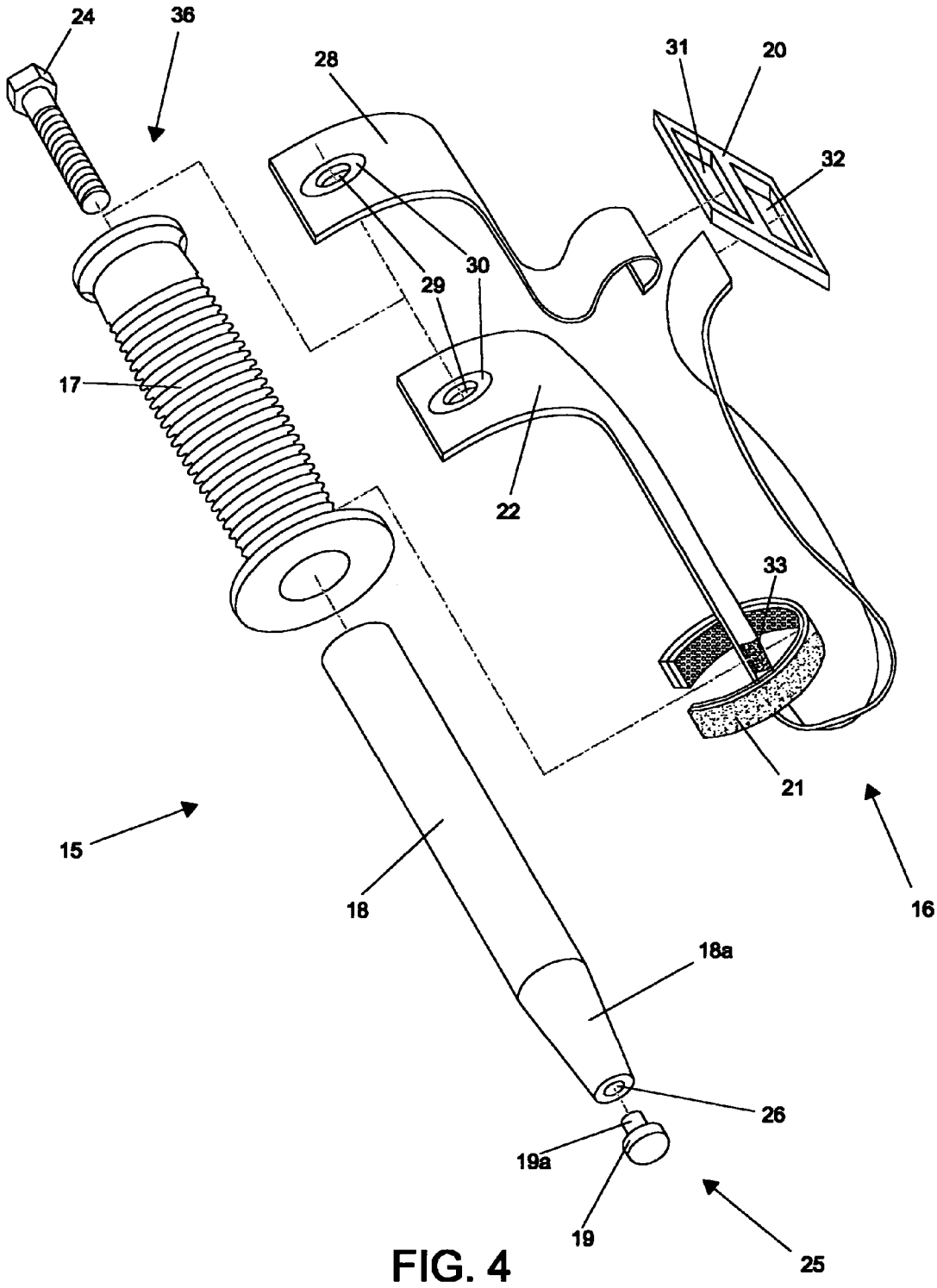
FIG. 4 is an exploded view of FIG. 1.

The shaft 18, as shown in FIG. 4, may be constructed of a durable material such as metal, metal alloy, resin, plastic or wood, depending on the desired cost, weight, corrosion resistance and or appearance characteristics. As shown in FIG. 1, the shaft 18 is demonstrated with an overall approximate length of 150 mm. The shaft 18 may be, for example, molded and or machined from readily available bar stock or rail, of the desired material, to support the grip 17 along its length. The shaft 18 may be further machined, at one end, to an approximately 40 mm long shaft taper 18*a*, terminating at a diameter, for example, similar in size to that of the average human finger tip or approximately 13 mm. Also at the tapered end of the shaft 18, an approximately 6 mm diameter shaft hole 26 or the like may be axially drilled to the depth of approximately 6 mm, so as to accept the bumper post 19*a* of stem bumper 19.

Figure 3:
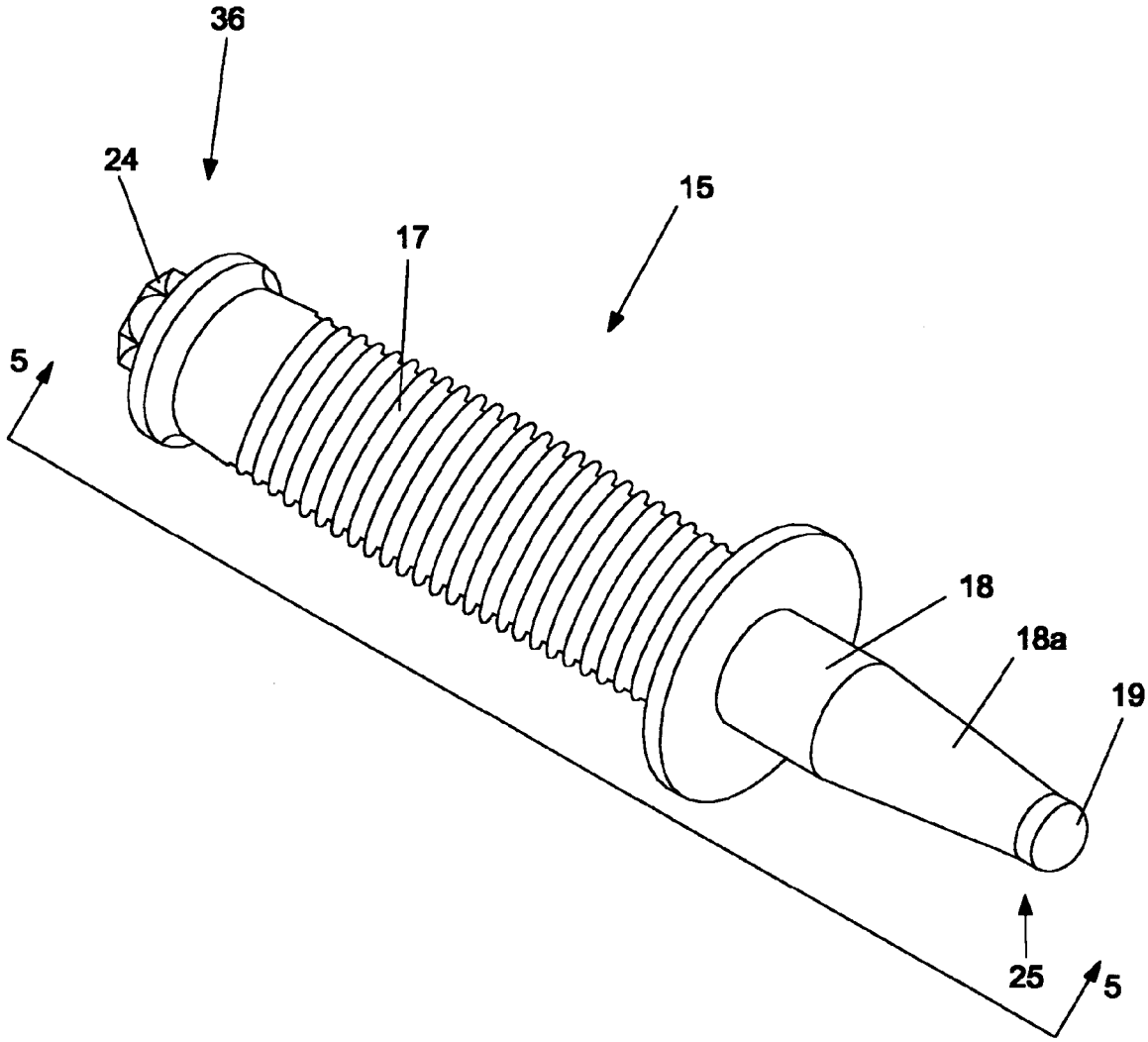
FIG. 3 is a perspective view of the first embodiment of the invention with the combination strap removed.
Figure 5:
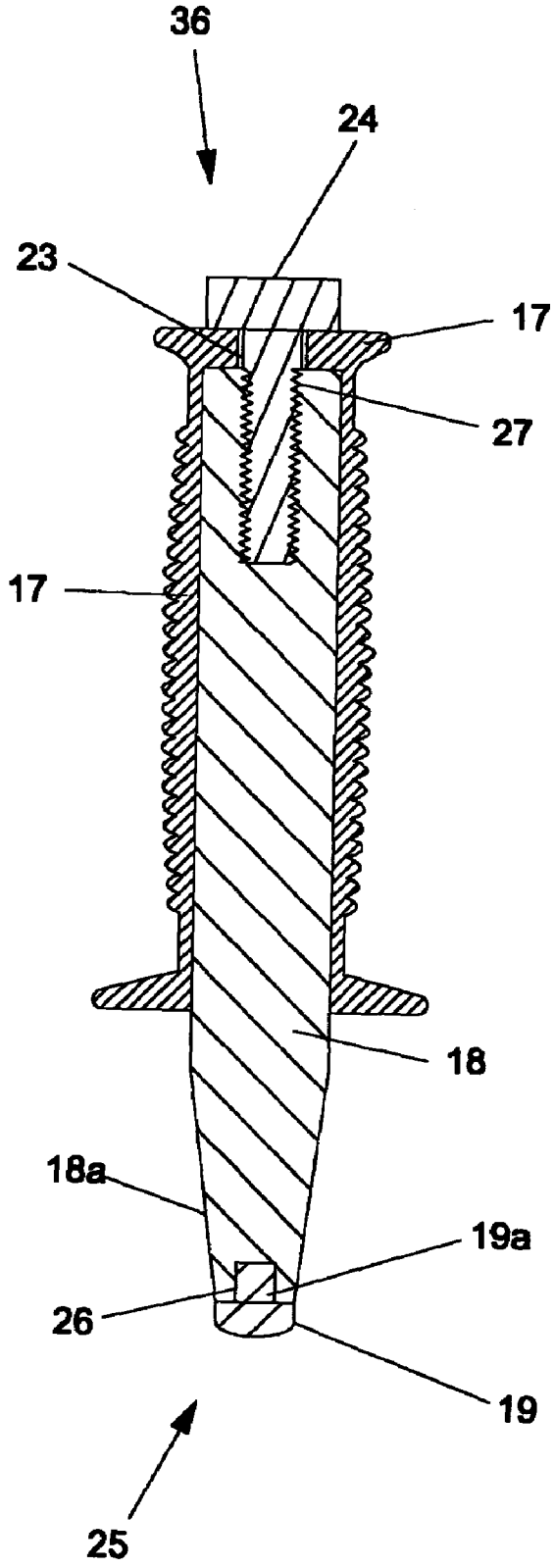
FIG. 5 is a cross-sectional view of FIG. 3, taken along lines 5—5.

Taken at section lines 5—5 in FIG. 3, FIG. 5 details the entire length of the shaft 18. In the strap end 36 of the shaft 18, a threaded hole 27 may be drilled and tapped, so as to threadably accept the attachment bolt 24. Also, an appropriate hole 23, may be bored into the butt of the grip 17 to permit the shank of the bolt 24 to pass through it. The grip 17 is fitted over the non-tapered length. of the shaft 18, the two parts adapted to have complementary inner and outer diameters, respectively, and may be held in place by the bolt 24. Alternatively, the grip 17 may be adhered to or otherwise fixed upon the shaft 18.

The bumper 19, also presented in FIG. 4, may be constructed of a resilient, non-slip, non-marring material such as styrene butadiene rubber (SBR), silicone or another polymer or material with similar properties and may be obtained from most industrial supply businesses or rubber part manufacturers. The stem bumper 19 preferably has an outside diameter equal to or larger than the outside diameter dimension of the tapered end of the shaft 18 to minimize the possibility of the shaft 18 coming in contact with any part of the instrument keys. The stem bumper 19 may be manufactured with, for example, a semispherical, semi-elliptical or flat strike point profile. The stem bumper 19 may also possess an approximately 6 mm diameter post 19*a* or the like, which can be attached to the end of the shaft 18 by simply sliding the post 19*a* into the shaft's 18 axially drilled shaft hole 26. The stem bumper 19 may be held in place by, for example, an interference fit or a common adhesive such as an epoxy or a cyanoacrylate glue. Where an interference fit is used, the bumper 19 is easily replaceable.

FIG. 4 shows an exploded view of the combination strap 16, which may be comprised of three straps, namely the slide strap 22, the stationary strap 28, the connecting strap 21, and a sliding buckle 20. Both the slide strap 22 and the stationary strap 28 may be made of flexible webbing material with an approximate width of, for example, 25 mm. The webbing may be formed from, for example, cotton, polypropylene, nylon, polyester, polyurethane or the like. As an alternative to woven webbing, leather or plastic strapping may also be used. The buckle 20 can be made of any type of common metal or plastic that is readily available. The style of the buckle 20 can vary and could include any type of squeeze release buckle, cam lever operated buckle, slide bar buckle, traditional belt buckle or other means for adjustable attachment. Alternatively the sliding buckle 20 and or stationary strap 28 may be replaced with any manner of strap length adjusting mechanisms, for example a series of holes through any one of which the attachment bolt 24 may be passed, to fix the length of the slide strap 22.

Both the slide strap 22 and the stationary strap 28 may be formed with strap holes 29 with metal or plastic grommets 30 punched and inserted into their centers, for example, approximately 25 mm from either end of each strap. The grommets 30 having a hole diameter complementary to the attachment bolt 24 can be installed by anyone having ordinary skill in the art of grommet installation, for example using a pliers type hand press. The grommets 30 may be added to add strength to the web material, which may otherwise be weakened by the creation of the strap hole(s) 29.

The stationary strap 28 web material may have, for example, an overall length of approximately 100 mm. The end of the stationary strap 28, opposite of the grommet 30, can be passed through the bottom of the first buckle opening 31 of the sliding buckle 20 and threaded back through the second buckle opening 32. The web can then be pulled through the sliding buckle 20, such that enough material is present to easily sew or otherwise fasten that same end to the underside of itself anywhere between the grommet 30 location and the sliding buckle 20.

The slide strap 22 web material, shown in FIG. 4, may have, for example, an overall length of approximately 280 mm. A slide strap loop fastener 33, for example, formed from an approximately 25 mm long section×16 mm wide piece of woven nylon loop fastener material, may be sewn or otherwise attached to either side of the web, approximately 125 mm from the end of the slide strap 22 containing the grommet 30. The end of the slide strap 22, opposite of the grommet 30 location, may be passed through the bottom of the first opening 31 in the buckle 20, looped over the center bar of the buckle 20 and previously installed loop of stationary strap 28, then passed back through the second opening 32 in the buckle 20. Both the stationary strap 28 and the slide strap 22 may be attached to the shaft 18, by inserting the attachment bolt 24 through both grommets 30, preferably such that the buckle 20 or other strap length adjustable attaching means will face away from the grip 17 when attached to the key pounder 15. The attachment bolt 24 may be inserted into the threaded hole 27 on the strap end 36 of shaft 18 through the drilled hole 23 in the grip 17, as can be seen in FIG. 5. The combination strap 16, when assembled in this configuration, as illustrated in FIG. 2, can be used as a wrist-strap and may be adjusted to suit the wrist and hand size of the user by repositioning the buckle 20 along the length of the strap 22.

The connecting strap 21, additionally shown in FIG. 4, may be comprised of, for example, a section of nylon hook fastener material, approximately 100 mm long×16 mm wide, sewn back to back to an approximately equal length and width of woven nylon loop fastener material. Anyone having ordinary skill in the art of sewing will have no difficulty in attaching the hook and loop fastener materials or the like to each other or attaching the web material to itself or the loop fastener, as described previously. The exposed hook fastener side of the connecting strap 21 can be pressed against and attached to the slide strap loop fastener 33. The connecting strap 21 can be drawn tight around the base of the grip 17 and fastened upon itself. Alternatively, the connecting strap 21 may also be made of any type of, for example, thin, textile or leather cord, or strap material that can be tied or fastened to itself. The combination strap 16, when assembled in this configuration as exhibited in FIG. 1, will consequently function as a hand strap and can be made snug around the back of the user's hand by repositioning the buckle 20 along the length of the slide strap 22.

The combination strap 16 may be omitted entirely or temporarily removed as shown in FIG. 3. Simply unfastening the connecting strap 21 and unscrewing the bolt 24 from the end of the strap end 36 of shaft 18 and grip 17 (see FIG. 4) may achieve this arrangement. The stationary strap 28 and the slide strap 22 can then be removed from the bolt 24. The bolt 24 can be reinserted into the threaded hole 27 of the shaft 18, as detailed in FIG. 5.

Figure 6:
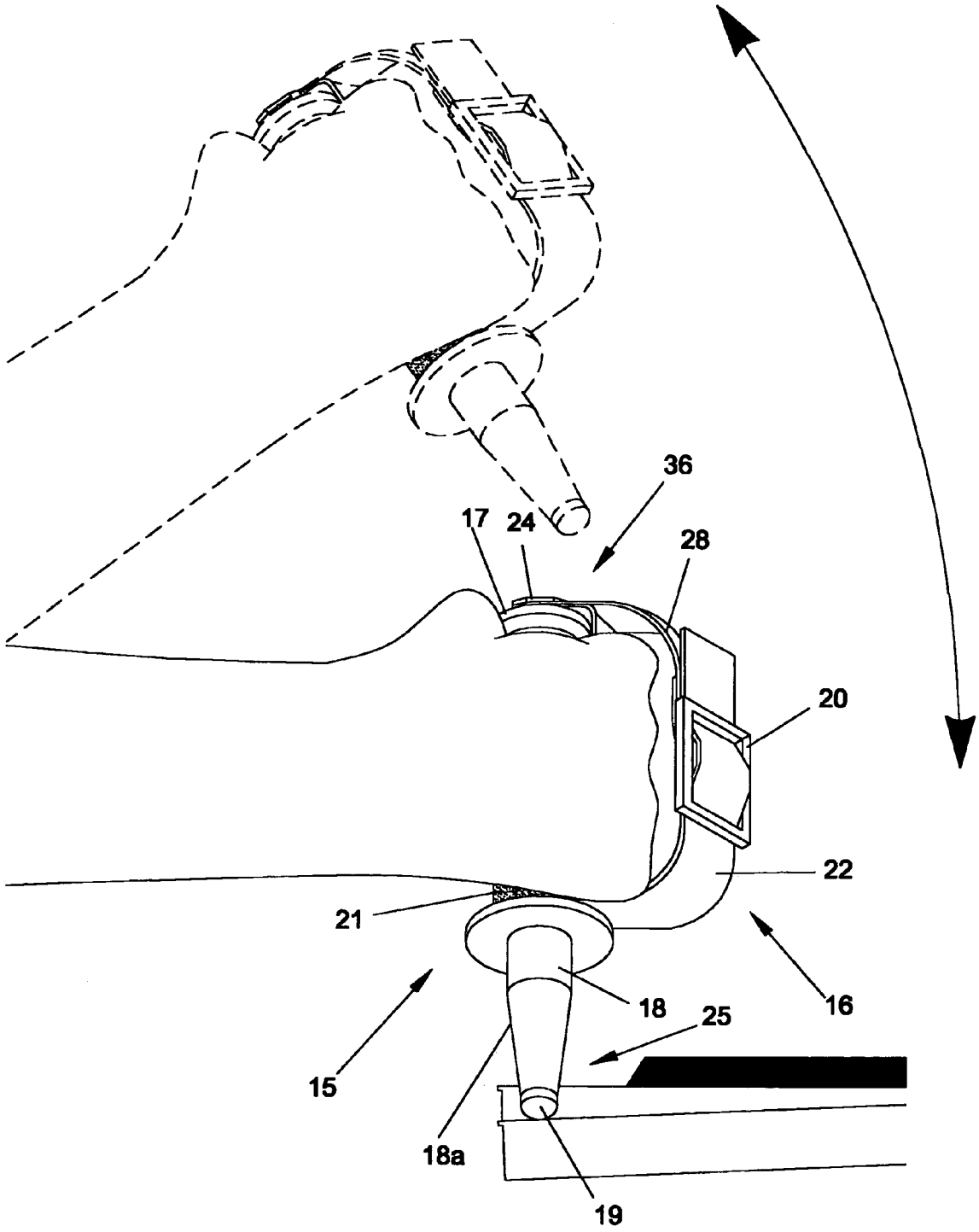
FIG. 6 is a perspective view of the ergonomic key pounder depicting its manner of use.

The ergonomic key pounder 15 with combination strap 16 may be used by placing a hand through the combination strap 16 opening, if attached, and grasping the key pounders 15 grip 17 with the same hand, as shown in FIG. 6. The device's shaft taper 18*a* and bumper 19 should extend below the side of the hand opposite of the thumb. The user then places the key pounder 15 vertically above the instrument key, associated with the string that is to be tuned, and then strikes that key with the exposed surface of the bumper 19, using a downward swinging motion pivoting from the elbow. The distance above the key, for which the key pounder 15 is initially positioned, is dependent on the amount of force that the user wishes to impart upon the key and can, for example, vary anywhere from a fraction of an inch to more than one foot.

Figure 7:
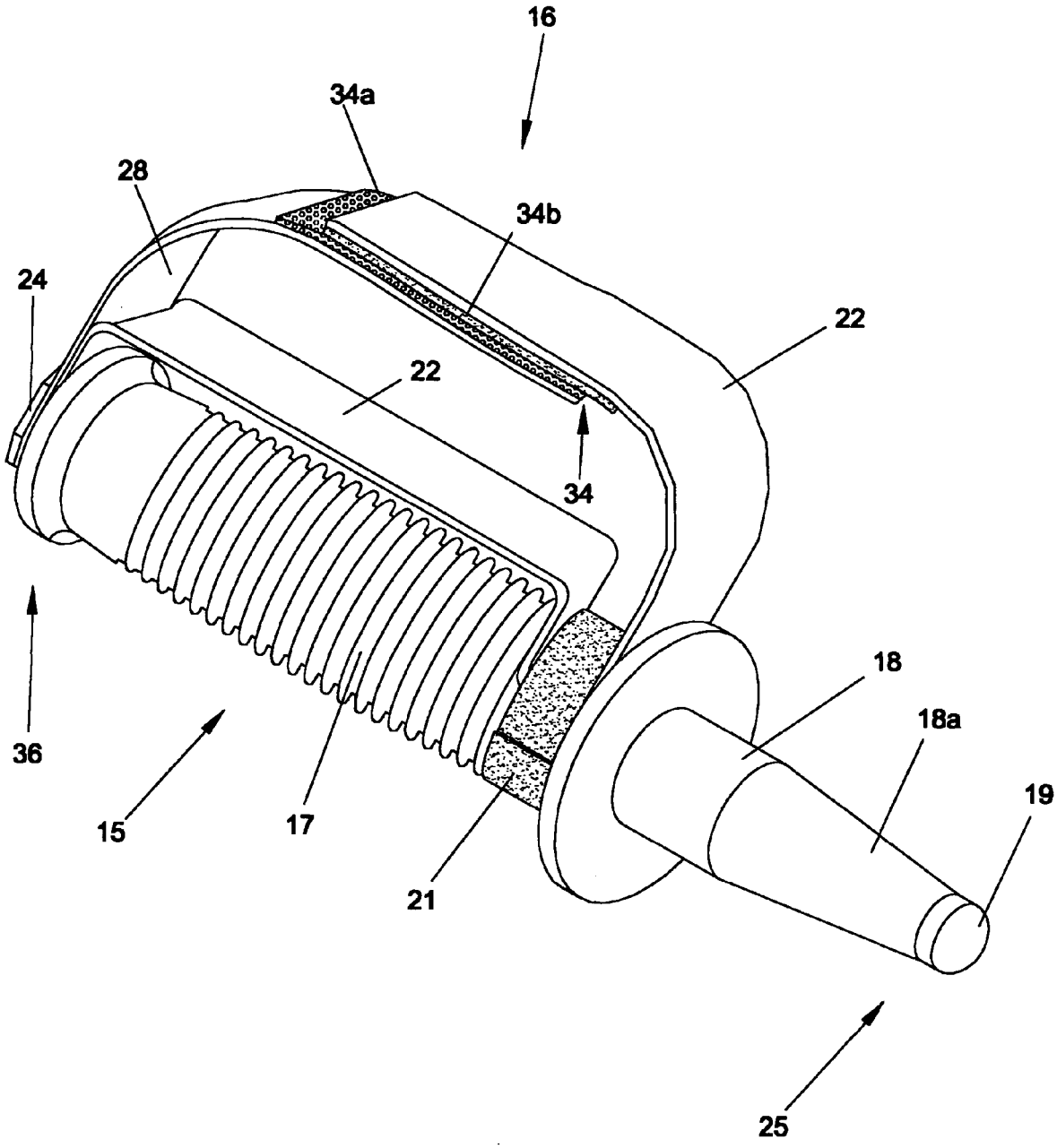
FIG. 7 is a perspective view of a second embodiment of the invention.

A second embodiment of the invention is presented in FIG. 7. The key pounder 15 is similar to that shown in FIGS. 1–5, except that the adjustable method of attachment to affix the stationary strap 28 to the slide strap 22 is a connecting strap fastener 34, which is a nylon hook and loop fastener, for example, approximately 25 mm wide×75 mm long. On the face of the stationary strap 28, at the end opposite of where it connects to the key pounder 15, the connecting hook fastener 34*a* is sewn or otherwise attached to the strap 28. On the opposing face of the slide strap 22, at the end opposite of its connection point to the key pounder 15, the connecting loop fastener 34*b* may be attached, in the form of, for example, an approximately 25 mm wide×75 mm long section of woven nylon loop fastener material.

Figure 8:
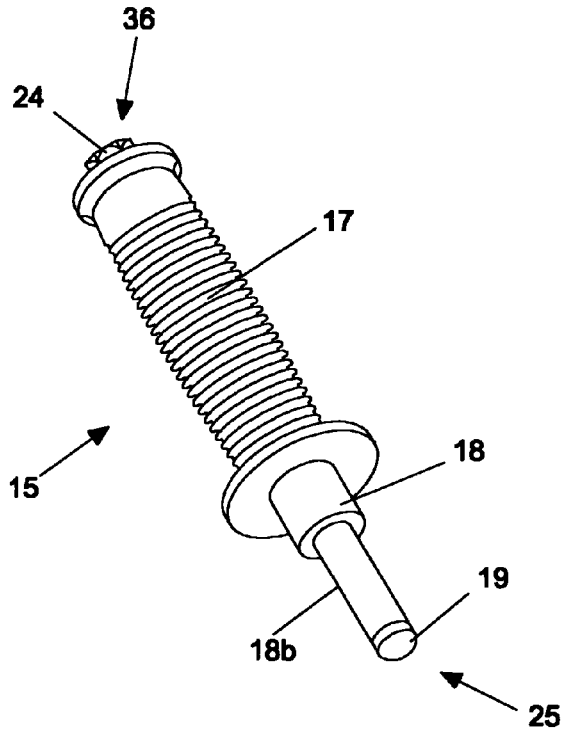
FIG. 8 is a perspective view of a third embodiment of the invention.

A third embodiment of the key pounder 15 of this invention is illustrated in FIG. 8. The key pounder 15 is similar to that shown in FIGS. 1–5, except that the shaft 18 possesses a stepped profile 18*b* to achieve the reduced cross-sectional area transition from the grip 17 to the optimally sized strike point cross-sectional area. This transition from the grip area to the optimally sized strike point area can also be attained by employing a shaft equal in cross-sectional area to that of the strike point and using a grip with a similarly-sized inside profile.

Figure 9:
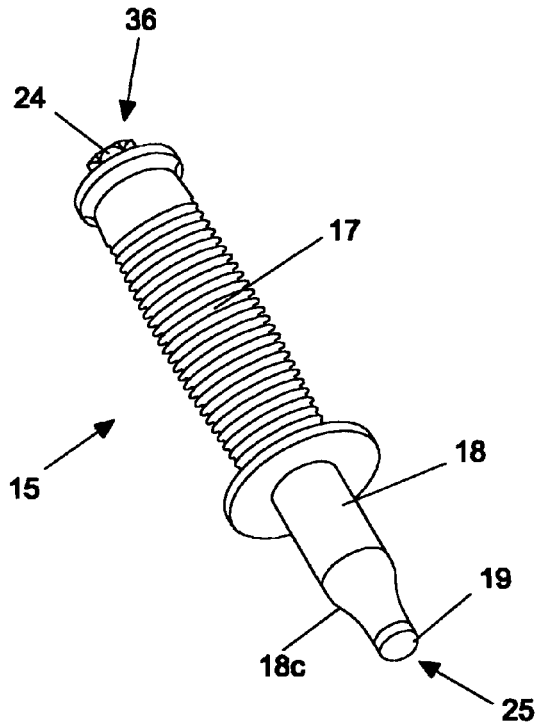
FIG. 9 is a perspective view of a fourth embodiment of the invention.

A fourth embodiment of the key pounder 15 of the invention is presented in FIG. 9. The key pounder 15 is similar to that shown in FIGS. 1–5, except that the shaft 18 radius has an ogee or S-shaped profile 18*c* to achieve the reduced cross-sectional area transition from the grip 17 to the optimally sized strike point cross-sectional area.

Figure 10:
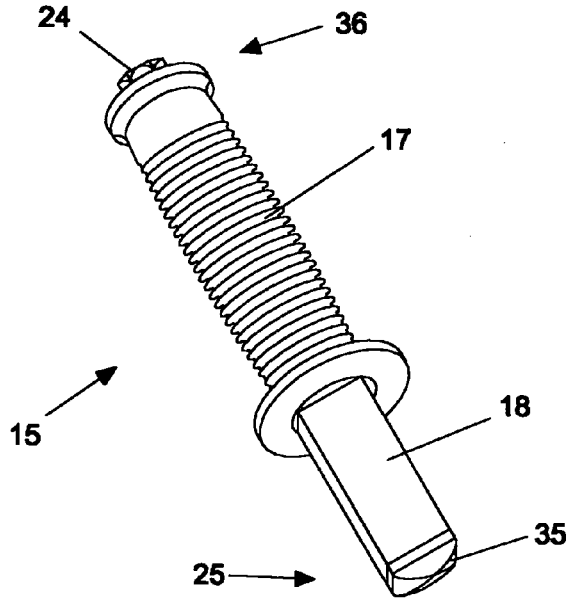
FIG. 10 is a perspective view of a fifth embodiment of the invention.

A fifth embodiment of the key pounder 15 of the invention is presented in FIG. 10. This key pounder 15 is also similar to that shown in FIGS. 1–5, except that the strike point is square or rectangular in shape, as is the square bumper 35. The transition from the grip cross-sectional area to the optimally sized strike point cross-sectional area can be accomplished by employing a shaft equal in area to that of the strike point and using a grip with a similarly sized and shaped, inside profile. Machining or molding the end of the shaft to the desired square or rectangular profile may also attain this transition from the grip cross-sectional area to an optimally sized strike point cross-sectional area.

Thus, one skilled in the art will appreciate that the ergonomic key pounder 15 with combination strap 16 of this invention can be used to strike musical instrument keys and increase the ease and efficiency of tuning pianos and the like by:

(a) minimizing finger, hand, and wrist strain;

(b) reducing the likelihood of inadvertent strikes to adjacent keys;

(c) providing a strike point which is readily visible to the user;

(d) reducing the possibility that the key pounder will slip off of, for example, targeted black keys and inadvertently strike adjacent white keys;

(e) accommodating various hand sizes and gripping techniques;

(f) permitting the user to play wide intervals with the hand operating the key pounder, without disengaging that hand from the key pounder Furthermore, the key pounder 15 has the advantage that its shaft 18 can be made of any of many materials, such that its overall weight and appearance can be selected to satisfy the user's personal taste, ergonomic and tuning needs.

While preferred embodiments of the present invention have been shown and described herein, it will become obvious that numerous omissions, changes and additions may be made therein without departing from the spirit and scope of the present invention.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

We claim:

1. A key pounder, comprising:

a grip disposed about a shaft which extends between a strap end and a bumper end;

a slide strap coupled to the strap end;

a stationary strap coupled to the strap end;

a means for adjustable attachment between the stationary strap and the slide strap; and a resilient non-slip bumper coupled to the bumper end.

2. The apparatus of claim 1 further including an attachment bolt adapted to threadably attach to the strap end and retain the slide strap to the shaft.

3. The apparatus of claim 1, further including a connecting strap adapted to removably couple the slide strap to the grip.

4. The apparatus of claim 3, further including a slide strap loop fastener attached to the slide strap adapted to couple the connecting strap to a desired location along the slide strap.

5. The apparatus of claim 1, wherein the bumper has an outer diameter greater than or equal to the bumper end of the shaft.

6. The apparatus of claim 5, wherein the bumper has a diameter of 17 millimeters or less.

7. The apparatus of claim 5, wherein the bumper has a diameter of 15 millimeters or less.

8. The apparatus of claim 5, wherein the bumper has a diameter of 13 millimeters or less.

9. The apparatus of claim 5, wherein the bumper has a diameter of 11 millimeters or less.

10. The apparatus of claim 1, wherein the shaft is one of metal, metal alloy, resin, plastic and wood.

11. The apparatus of claim 1 wherein the bumper is one of styrene butadiene rubber, polyurethane, polyethylene, silicone, vinyl and thermoplastic elastomer.

12. The apparatus of claim 1, wherein the grip is one of rubber, vinyl, foam rubber and foam vinyl.

13. The apparatus of claim 1, wherein the bumper is removably coupled to the bumper end via an interference fit of a bumper post of the bumper into a shaft hole of the bumper end.

14. The apparatus of claim 1, wherein the grip has a plurality of ribs radiating circumferentially along a longitudinal axis thereof.

15. The apparatus of claim 1, wherein the shaft diameter covered by the grip is greater than the shaft diameter at the bumper end.

16. The apparatus of claim 15, wherein the shaft diameter transitions between the shaft diameter covered by the grip and the shaft diameter at the bumper end via one of a taper, curve, step and ogee shaped profile.

17. A key pounder, comprising:

a grip disposed about a shaft which extends between a strap end and a bumper end;

a resilient non-slip bumper coupled to the bumper end;

a slide strap coupled to the strap end;

a stationary strap coupled to the strap end;

a means for adjustable attachment between the slide strap and the stationary strap; and a connecting strap adapted to removably couple the slide strap to the grip.

18. A key pounder comprising:

a grip having a plurality of ribs radiating circumferentially along a longitudinal axis thereof, the grip disposed about a shaft which extends between a strap end and a bumper end having an attachment bolt coupled to the shaft end which retains the grip upon the shaft;

the shaft extending between the grip and a bumper end;

a resilient non-slip bumper coupled to the bumper end has an outer diameter equal to or greater than a diameter of the shaft at the bumper end.

* * * * *